United States Patent [19]

Handa

[11] 4,083,438

[45] Apr. 11, 1978

[54] ESCAPE DEVICE

[76] Inventor: Kuninori Handa, 3082-8, Imamenshingai, Sanba-cho, Onomichi-shi, Hiroshima-ken, Japan

[21] Appl. No.: 722,312

[22] Filed: Sep. 10, 1976

[30] Foreign Application Priority Data

Sep. 11, 1975 Japan ..... 50-110777

[51] Int. Cl.[2] ..... B65H 59/14

[52] U.S. Cl. ..... 188/65.3

[58] Field of Search ..... 182/5, 7; 188/65.1, 188/65.3, 65.4

[56] References Cited

U.S. PATENT DOCUMENTS 1,194,062 8/1916 Piche' ..... 188/65.1 X

*Primary Examiner*—Duane A. Reger

*Attorney, Agent, or Firm*—William Anthony Drucker

[57] ABSTRACT

The present invention relates to a descent or escape device which can be used in a safe and easy manner as a means of emergency escape upon occurrence of a fire in hotels and other buildings, and also as a safety means for working in high places. The escape device is used together with a single rope and has such a structure that said rope is always stressed by the load of a person's body weight, thereby causing a braking action to control the speed of descent. The descent or escape device therefore ensures easy and safe descent at a desired speed of descent by appropriately manipulating an operating rod of the descent device.

2 Claims, 9 Drawing Figures

FIG. 1
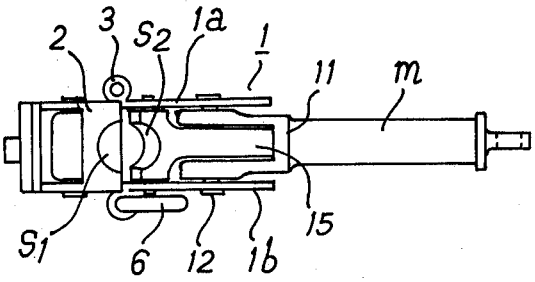
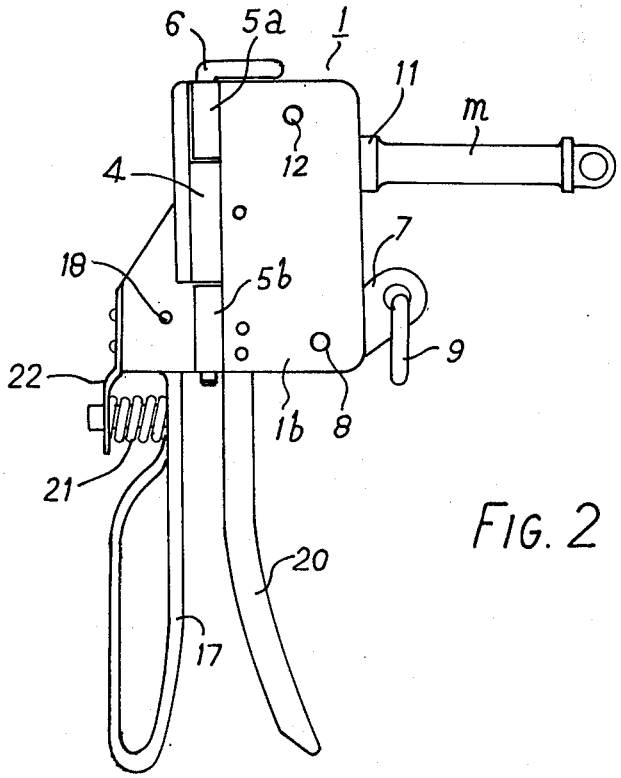
FIG. 2

FIG. 3A
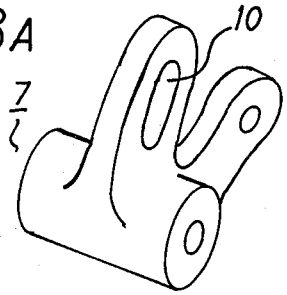
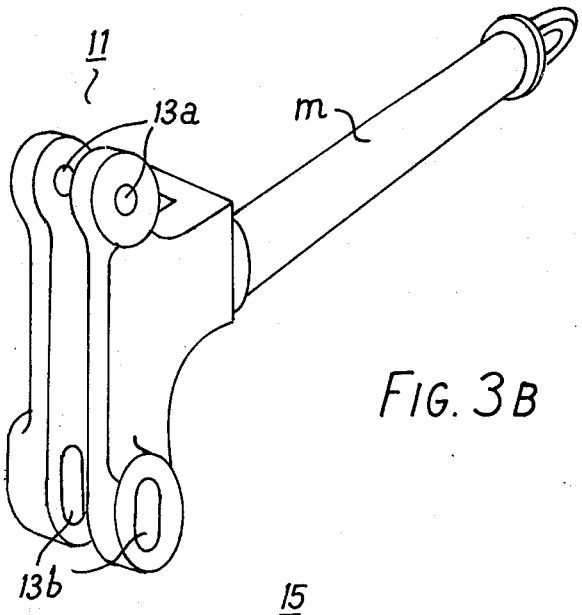
FIG. 3B
FIG. 3C
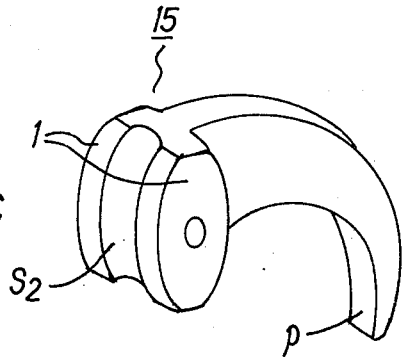

FIG. 6
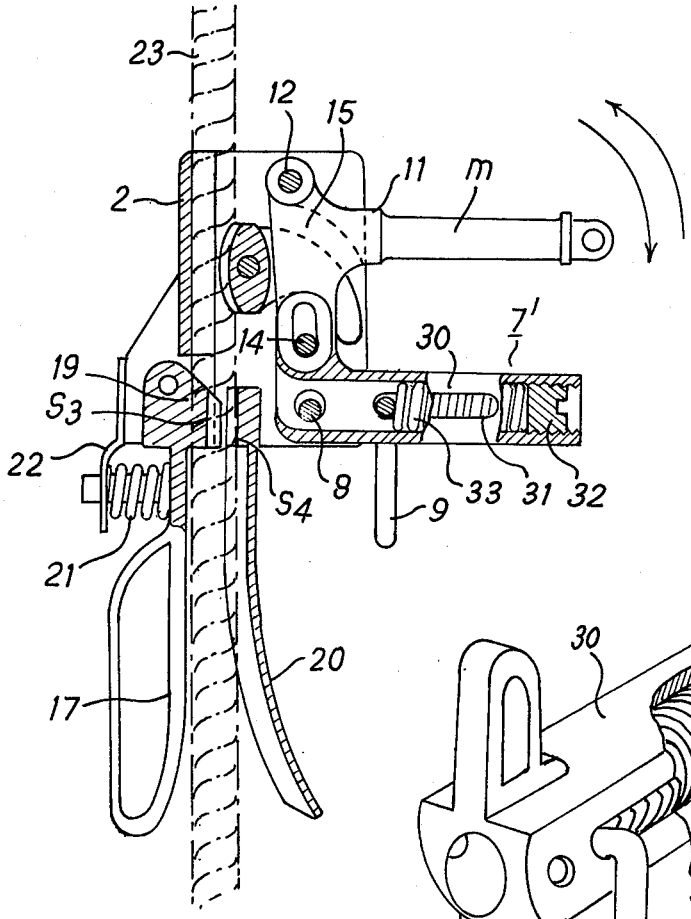
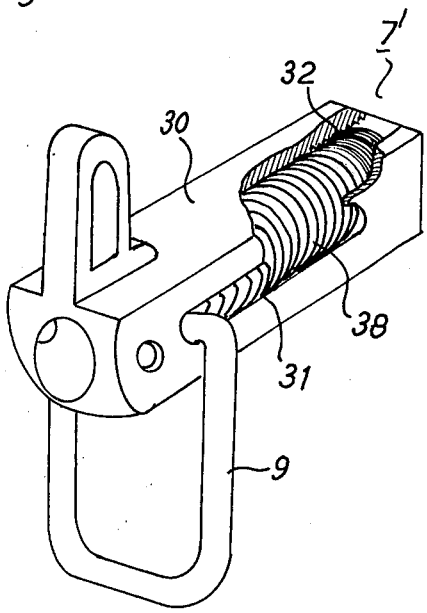
FIG. 7

ESCAPE DEVICE

BACKGROUND OF THE INVENTION

In a conventional descent device which is also used together with a rope, said rope is wound either on a shaft or on an S-shaped groove or the like. A man than hangs down from the device, whilst grasping said rope, and travels down by loosening the underside rope provided through the device. Accordingly, if someone on the ground should pull the rope by mistake, the descent movement will be discontinued. Then, even if it is necessary to change the descent position to avoid dangers or obstacles when the device is used as a means of escape, rescue personnel on the ground cannot change the descent position. Furthermore, as a subsequent person cannot descent until the rope is loosened after the former person completely touches down on land, the efficiency of escape in emergency is not very satisfactory.

If, to regulate the speed of descent, a person directly grasps the underside rope of the device, and if that person then becomes unconscious as he firmly grasps the underside rope of the device during a falling movement, no one can then bring him down, and subsequent descending movements will not be possible. Further, no one can approach an unconscious person, when descending to rescue him. On the contrary, if a person releases his hand from said rope, he will be killed by the resultant drop.

Furthermore, the higher the escape position becomes, the longer the rope become and the heavier the weight of said rope itself becomes. Therefore, it will be difficult to descend by loosening the rope, when the weight of said rope is great. Thus, it is impossible to use such a conventional escape or descent device for escape from an extremely high position.

There are also known other devices such as those of wellbucket type, by which alternate descents are available, in which a block having a brake is employed. However, this type of descent device is large in size, and expensive in production and installation. Furthermore, said type of device cannot take down several persons at the same time.

SUMMARY OF THE INVENTION

The present invention has solved many faults existing in each of the conventional types of device.

It is a primary object of the present invention to provide a novel and improved descent device which can ensure free inclined descent to avoid dangers and obstacles during a descent movement. For example, in the case where flames are suddenly blown up from a lower floor, the falling speed is reduced by manipulating the operation rod or a descending person can stop at any desired position on a rope for checking conditions below. At this time, a rescue operative on the ground can pull the lowest end of the rope toward a safe place, causing said rope to be inclined to ensure safe descent without obstacles and danger.

Another object of the present invention is to provide a novel and improved descent device which ensures continuous descent of several persons at the same time by a single rope, thereby ensuring very efficient descent in a short time.

A further object of the present invention is to provide a novel and improved device by which even a person who has become unconscious during descent is securely stopped at that position, and a subsequent person descending from above can take the former (lower) person down in an easy and safe manner.

Another object of the present invention is to provide a novel and improved descent device by which a person can descend from any higher position under the same conditions, thereby ensuring safe descent irrespective of the weight of a rope.

A still further object of the present invention is to provide a novel and improved descent device of which the structure and construction are very simple, whereby said device is completely free from any trouble during emergency descent and escape.

REFERENCE TO THE DRAWINGS.

The foregoing and other objects and features of the present invention will become apparent upon consideration of the following specification and appended claims taken in conjunction with the accompanying drawings in which:-

FIG. 1 is a plan view of a device according to the present invention;

FIG. 2 is a front elevational view of the device;

FIGS. 3A, 3B, 3C, are views of components employed in the device, and FIG. 3A is an enlarged perspective view of an L-shaped lever, FIG. 3B is an enlarged perspective view of an operation rod of the device, and FIG. 3C is an enlarged perspective view of a stop pawl of the device;

FIG. 6 is a longitudinal sectional view illustrating another example of the device of the present invention;

FIG. 7 is a perspective view of a detail illustrating a lever part employed in the device shown in FIG. 6.

DESCRIPTION OF THE PREFERRED EMBODIMENT

Figure 4:
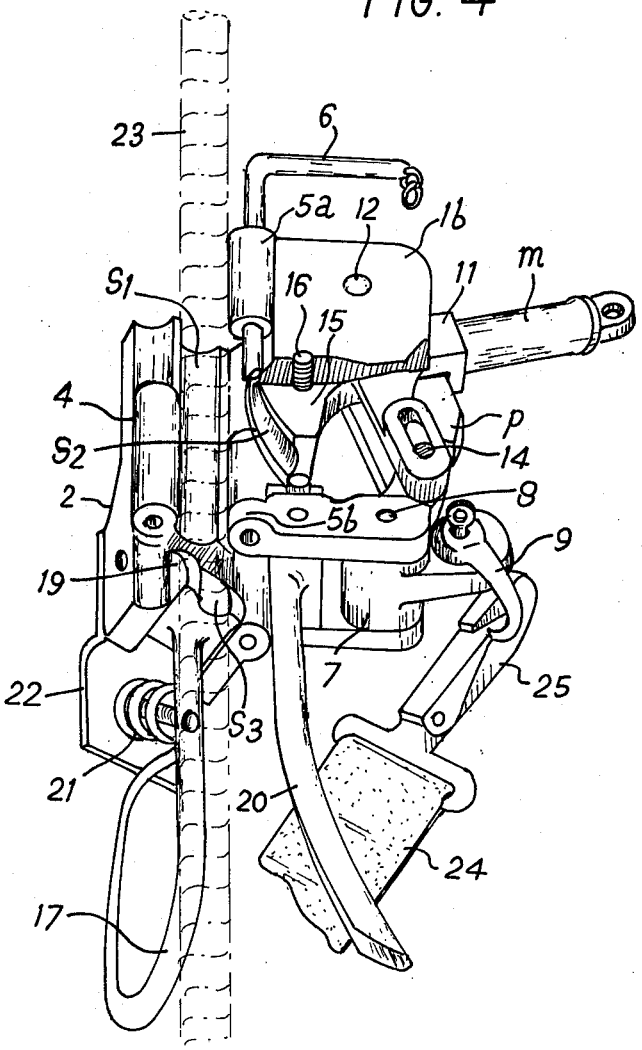
FIG. 4 is a perspective view, partially cut away, showing the mounting of the device of the present invention on a simple rope.

A casing accommodating the mechanism of the present invention is denoted by numeral 1. A lid member 2, provided with a groove $S_1$ for rope passing inside it, is mounted on a side wall 1*a* of said casing 1 by hinges 3 so that said lid member 2 can be freely opened and closed. The side of said lid member 2 opposite to said hinges 3 is provided with a hollow bracket 4 and the side wall 1*b* of said casing 1 is provided in relation to said hollow bracket 4 with two hollow brackets 5*a* and 5*b* between which said hollow bracket 4 is fitted. Said lid member is thereby kept closed by inserting a pin 6 into these brackets 5*a*, 4 and 5*b*.

An L-shaped lever 7 is movably mounted at the lower side wall part of said casing 1 by a pin 8. A suspension ring 9 is mounted at the lower end of said lever projecting from the casing 1. Said suspension ring 9 is constructed in such a manner that a safety belt, hereinafter described in detail, can be mounted to support the body of a person, and the upper end of said lever 7 located inside said casing 1 is provided with an elongated slit 10.

An operating rod 11 is movably mounted on the upper side wall of said casing 1 by providing in the holes 13*a* of said rod 11 a pin 12. The root part of said operating rod 11, except the grip part *m*, is constructed as a fork. The upper end of said L-shaped lever 7 is inserted in the lower end of said rod 11, and the lower holes 13*b* of said rod 11 are linked with said slit 10 of said lever 7 by a pin 14.

Figure 5:
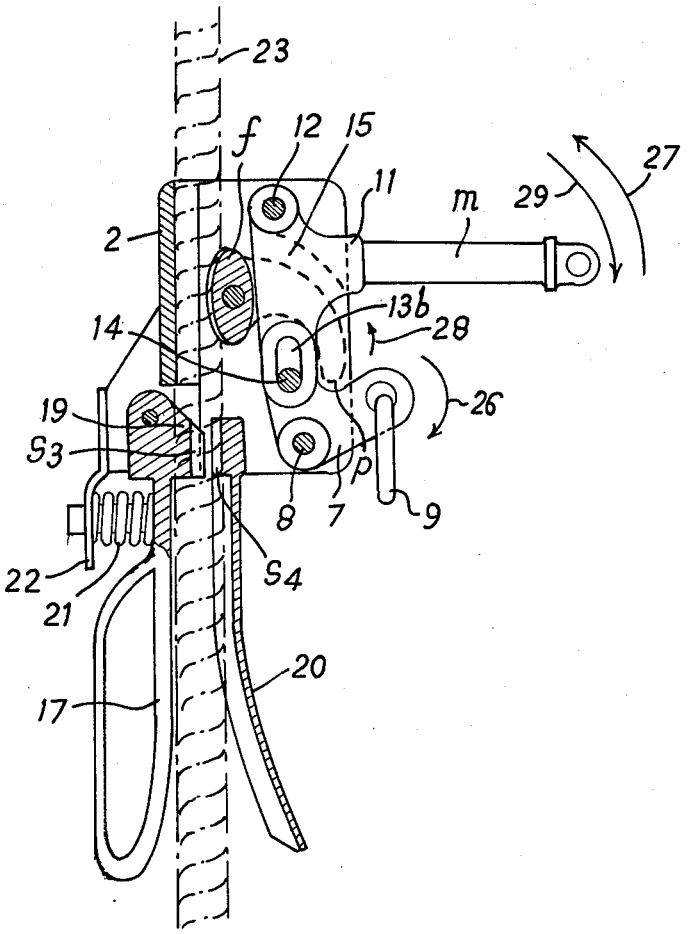
FIG. 5 is a sectional view illustrating the operating state of the device when a person is descending.

A bar-shaped pawl 15 is movably mounted on the central part of said casing 1 by a pin 16. The end *p* of said pawl faces downwardly and is inserted in the forked part of said operating rod 11. As shown in FIG. 5, said pawl is fitted in such a manner that it may cover the inside of said lever 7 when the grip part *m* of said operating rod 11 is positioned horizontally. On the other hand, the rear end part *f* of said pawl 15 is elliptical and is provided with a groove $S_2$ forrope. As shown in FIG. 5, the short-diameter side of the elliptical part of said pawl 15 faces said lid member 2 when the tip end of said pawl 15 is fitted to said lever 7 with said grip part *m* of said operating rod 11 horizontal.

An auxilliary rod 17 is movably mounted on the lower end of said lid member 2 by a pin 18 in such a manner that said rod 17 may be perpendicular. A projection 19 directed toward the inside of said casing 1 is formed at the upper end of said auxiliary rod 17 and is provided with a groove $S_3$ for rope. A guide rod 20 is fixedly mounted on the lowest side wall of said casing 1 in such a manner that said guide rod 20 may face said auxiliary rod 17. A groove $S_4$ for rope is provided at the inside of said guide rod 20. Numeral 21 denotes a spring which is located between a plate 22 mounted at the rear side of said lid member 2 and said auxiliary rod 17. Said spring 21 urges said projection 19 of said auxiliary rod 17 toward said guide rod 20, whereby a rope located between said groove $S_3$ and $S_4$ is strongly nipped to ensure an auxiliary braking function.

The following description explains the operation of the device disclosed by the present invention, and how to use said device. A rope 23 is installed at a window of a building or on the handrail on a housetop and is suspended to the ground. Next, said pin 6 of said descent device is removed, and said lid member is opened to set a rope between said lid member 2 and said casing 1. Then said lid member 2 is closed and said pin 6 is inserted into said hollow brackets 5*a*, 4 and 5*b*.

A hook 25 of a safety belt 24, into which a person's body is set, is fitted in said suspension ring 9 and the man hangs down from the rope 23. At this time, as there is the load of a body weight, the L-shaped lever 7 turns in the clockwise direction, arrow 26, thereby causing the grip *m* of said operating rod 11 to be turned in the counter-clockwise direction, arrow 27. Accordingly, the pawl 15 is turned in the counter-clockwise direction, arrow 28, as well. At this time, as the rear end part *f* of said pawl 15 is elliptical, the rotation of said pawl 15 in the counter-clockwise direction causes the long-diametered side of said elliptical part of said pawl 15 to be pushed out toward said lid member 2. Said rope is thereby urged toward said lid member 2. Accordingly, the descent device of the present invention can automatically stop on said rope together with a person.

Next, when a man begins to descend, said operating rod 11 is grasped by him. Then, when said operating rod 11 is pushed down by external force in the reverse direction, i.e. the counter-clockwise direction, arrow 29, to said turn direction, arrow 27, of said rod 11, the pressing force caused by the combination of the person's weight and the long-diametered side of said elliptical part of said pawl 15 is removed, thereby ensuring a smooth descent. If the speed of descent is accelerated, the hand may be releasing from said operating rod 11. Furthermore, the descent speed is decelerated by strongly pushing said auxiliary rod 17 against said guide rod 20. Said auxiliary rod 17 is usually grasped for stabilizing the body by hand. Accordingly, a braking function is obtained by that said projection part 19 of said auxiliary rod 17 pressing said rope 23 against said guide rod 20.

As described above, the device of the present invention ensures continuous escape or descent from any desired floor by suspending a rope from the top of a building. Safe descent is secured by regulating the speed of descent by manipulating said operation rod 11. Further, even if a person falls unconscious during his descent, a subsequent descending person can push down the operating rod of that descent device, from which the unconscious person is suspended, with his foot, so that both of them can descend in safety.

FIG. 6 illustrates another example of a device of the present invention. An L-shaped lever 7' shown in FIG. 7 is employed in this example. Although the position of the suspension ring 9 in the former example is fixed, the suspension ring of said L-shaped lever is formed as a cylindrical member 30. In this example, a suspension ring 9 is shiftably mounted on said cylindrical member 30 which is provided with a slit 31 in its longitudinal direction. Said suspension ring is shiftably fitted in said slit 31 and is fixedly pressed toward a pin 8 of a fulcrum with pressure regulated by a set screw 32 and a spring 33.

When such an L-shaped lever 7' is employed, the pressing force of pawl 15 against a rope 23 can be kept fixed irrespective of the body weight of a descending person, whereby persons can descend at a certain safe fixed speed. Further, automatic descent is also available without the use of said operating rod, by setting a spring pressure to a certain desired value by adjusting set screw 32.

According to experiments carried out by the inventor, four persons can descend at the same time on a nylon rope of diameter 12mm., and seven or eight persons can descend at the same time on a nylon rope of a diameter 16mm. (in both cases, the safety ratio is 10 times).

The above description only covers the example of emergency escape or descent from buildings. However, the descent device of the present invention can be used for the cleaning of outer walls and windows of buildings, and for high places of work in building construction. Moreover, it can be widely used as an auxiliary safety device for many kinds of high place working in building and construction work.

Certain novel features and details of the present invention are disclosed herein, and in some cases in considerably detail, in order to make the invention clear in at least one form thereof. However, it is to be clearly understood that the invention, as disclosed, is not necessarily limited to the exact form and details disclosed since it is apparent that various modifications and changes may be made without departing from the spirit and scope of the invention.

I claim:

1. A descent and escape device comprising a casing, a lid movably mounted on said casing for opening of the casing to insert a rope, a two-arm lever journalled in said casing and having a slot in one of its arms, an operating rod journalled in said casing and including a presser portion and an arm, said presser portion being movable towards and away from said lid and defining with said lid a passage of variable cross-section to receive said rope, a pawl arm abutting said operating rod, and means on the other arm of said two-arm lever for suspending a body therefrom, the arrangement being such that rotating of said two-arm lever by bodyweight causes rotation of said operating rod and of said pawl arm in the direction to cause said presser portion and said lid to grip the rope, comprising an auxiliary rod journalled on said casing and including a projection, a guide rod on said casing defining with said projection a passage for said rope, and spring means acting between said auxiliary rod and said guide rod to urge said guide rod in the direction to tighten said projection and guide rod onto said rope.

2. A descent and escape device comprising a casing, a lid movably mounted on said casing for opening of the casing to insert a rope, a two-arm lever journalled in said casing and having a slot in one of its arms, an operating rod journalled in said casing and including a presser portion and an arm, said presser portion being movable towards and away from said lid and defining said said lid a passage of variable cross-section to receive said rope, a pawl arm abutting said operating rod, and means on the other arm of said two-arm lever for suspending a body therefrom, the arrangement being such that rotating of said two-arm lever by bodyweight causes rotation of said operating rod and of said pawl in the direction to cause said presser portion and said lid to grip the rope, wherein said other arm of said two-arm lever is a hollow cylinder having a longitudinal slot in its side wall, and wherein said suspending means is a suspension ring fitted in said slot and urged towards the axis of rotation of said two-arm lever by spring means.

* * * * *